US007205975B2

(12) United States Patent
Kim

(10) Patent No.: US 7,205,975 B2
(45) Date of Patent: Apr. 17, 2007

(54) DISPLAY APPARATUS AND METHOD

(75) Inventor: Jae-hyun Kim, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 507 days.

(21) Appl. No.: 10/732,247

(22) Filed: Dec. 11, 2003

(65) Prior Publication Data

US 2004/0130521 A1 Jul. 8, 2004

(30) Foreign Application Priority Data

Jan. 4, 2003 (KR) ..... 10-2003-0000437

(51) Int. Cl.
*G09G 3/36* (2006.01)

(52) U.S. Cl. ..... 345/102; 345/63

(58) Field of Classification Search ..... 345/52, 345/63, 69, 70, 77, 80, 84, 87, 88, 91, 101, 345/102; 315/158; 349/30, 61; 362/30, 362/246, 800

See application file for complete search history.

(56) References Cited

U.S. PATENT DOCUMENTS

2002/0158861 A1* 10/2002 Maksimovic et al. ..... 345/211

FOREIGN PATENT DOCUMENTS

| | | | |
|---|---|---|---|
| CN | 1311504 | | 9/2001 |
| EP | 1291 842 | A1 * | 9/2002 |
| JP | 09304751 | A * | 11/1997 |
| KR | 2004-62099 | | 7/2004 |

OTHER PUBLICATIONS

Chinese Office Action for Application No. 2003101243500; dated May 19, 2006.

Korean Office Action for application 10-2003-0000437, dated Feb. 19, 2005, 2 pp.

* cited by examiner

*Primary Examiner*—Nitin Patel
(74) *Attorney, Agent, or Firm*—Staas & Halsey LLP

(57) ABSTRACT

A display apparatus and method according to which ambient temperature of the display apparatus is measured, and a backlight driving voltage of the display apparatus is controlled based on the measured temperature. A display apparatus includes a backlight, a temperature sensing unit, and a voltage control unit. The backlight provides light to the display apparatus, and the temperature sensing unit measures the ambient temperature of the display apparatus. The voltage control unit compares the measured temperature to a predetermined temperature and controls a voltage applied to the backlight.

10 Claims, 4 Drawing Sheets

DISPLAY APPARATUS AND METHOD

CROSS-REFERENCE TO RELATED APPLICATIONS

This application claims the priority of Korean Patent Application No. 2003-437, filed on Jan. 4, 2003, in the Korean Intellectual Property Office, the disclosure of which is incorporated herein in its entirety by reference.

BACKGROUND OF THE INVENTION

1. Field of the Invention

The present invention relates to a display apparatus and a method to operate the display apparatus, and more particularly, to a display apparatus and method according to which ambient temperature of the display apparatus is measured and a backlight driving voltage of the display apparatus is controlled based on the measured temperature.

2. Description of the Related Art

In recent years, with increasing demand for display apparatuses, minimizing power consumption, which is directly related to duration of use, has attracted much attention. Generally, most portable devices with screens adopt a Liquid Crystal Display (LCD).

FIG. 1 is a block diagram of a conventional LCD backlight inverter system. Referring to FIG. 1, the conventional LCD backlight inverter system includes a video source device 100, a scaler 101, a timing control unit 102, an LCD 103 having a backlight 103-1, a luminance control unit 104, an inverter 105, a transformer 106, and a shut-down unit 107.

The video source device 100 generates a video source and processes the video source as displayable signals. The scaler 101 scales video signals including luminance signals from the video source device 100, and outputs the scaled video signals. The timing control unit 102 holds the video signals from the scaler 101 and outputs the video signals to the LCD 103. The luminance control unit 104 outputs a luminance control signal of the backlight 103-1 that lights the back of an LCD panel to make a screen of the LCD 103 highly visible. The inverter 105 generates a Pulse Width Modulation (PWM) frequency that controls the luminance of the backlight 103-1, and outputs the PWM frequency to the transformer 106. The transformer 106 transforms the PWM frequency from the inverter 105 to operate the backlight 103-1. When a problem occurs due to change in a backlight driving voltage, the shut-down unit 107 maintains a current applied to the backlight 103-1, and stops the operation of the inverter 105 to prevent any damage to the LCD backlight inverter system.

The conventional LCD backlight inverter system requires a high backlight driving voltage to turn the backlight 103-1 on at a low temperature. However, if the backlight driving voltage is too high at room temperature, when something inside the backlight 103-1 breaks or there is a problem with an input voltage, the shut-down unit 107 does not operate, causing damage to the LCD backlight inverter system. Generally, in order to avoid this problem, the backlight driving voltage is manually set to a predetermined value that does not cause a problem at both room temperature and at temperatures lower than the room temperature. Thus, because the backlight driving voltage does not correspond to the current temperature, the above mentioned problem still exists.

SUMMARY OF THE INVENTION

An aspect of the present invention provides a display apparatus, which measures ambient temperature and controls a backlight driving voltage based on the measured temperature.

Another aspect of the present invention also provides a display method to measure ambient temperature of a display apparatus and to control a backlight driving voltage of the display apparatus based on the measured temperature.

According to an aspect of the present invention, a display apparatus is provided that comprises: a backlight to provide light to the display apparatus, a temperature sensing unit to measure ambient temperature of the display apparatus, and a voltage control unit to compare the measured temperature to a predetermined temperature and to control a voltage applied to the backlight.

Additional aspects and advantages of the invention will be set forth in part in the description which follows and, in part, will be obvious from the description, or may be learned by practice of the invention.

The voltage control unit further comprises: a switching unit to output anon switching signal or an off switching signal according to the comparison result, and a voltage controlling device to control the voltage applied to the backlight in response to the on switching signal or the off switching signal.

According to an aspect of the present invention, when the measured temperature is below the predetermined temperature, the voltage control unit increases the voltage applied to the backlight by a predetermined value, and when the measured temperature is above the predetermined temperature, the voltage control unit decreases the voltage applied to the backlight by the predetermined value.

According to another aspect of the present invention, a method to operate a display apparatus is provided. The method of operation comprises: measuring ambient temperature of the display apparatus, comparing the measured temperature to a predetermined temperature, and controlling a voltage applied to a backlight that provides light to the back of the display apparatus.

According to another aspect of the invention, the operation of comparing the measured temperature to the predetermined temperature further comprises: outputting on switching signal or off switching signal based on the comparison result, and controlling the voltage applied to the backlight in response to the on switching signal or the off switching signal.

According to another aspect of the invention, the operation of comparing the measured temperature to the predetermined temperature further comprises: increasing the voltage applied to the backlight by a predetermined value when the measured temperature is below the predetermined temperature, and decreasing the voltage applied to the backlight by the predetermined value when the measured temperature is above the predetermined temperature.

BRIEF DESCRIPTION OF THE DRAWINGS

The above and/or other aspects and advantages of the invention will become apparent, and more readily appreciated from the following description of the preferred embodiment, taken in conjunction with accompanying drawings of which.

DETAILED DESCRIPTION OF THE PREFERRED EMBODIMENTS

Figure 1:
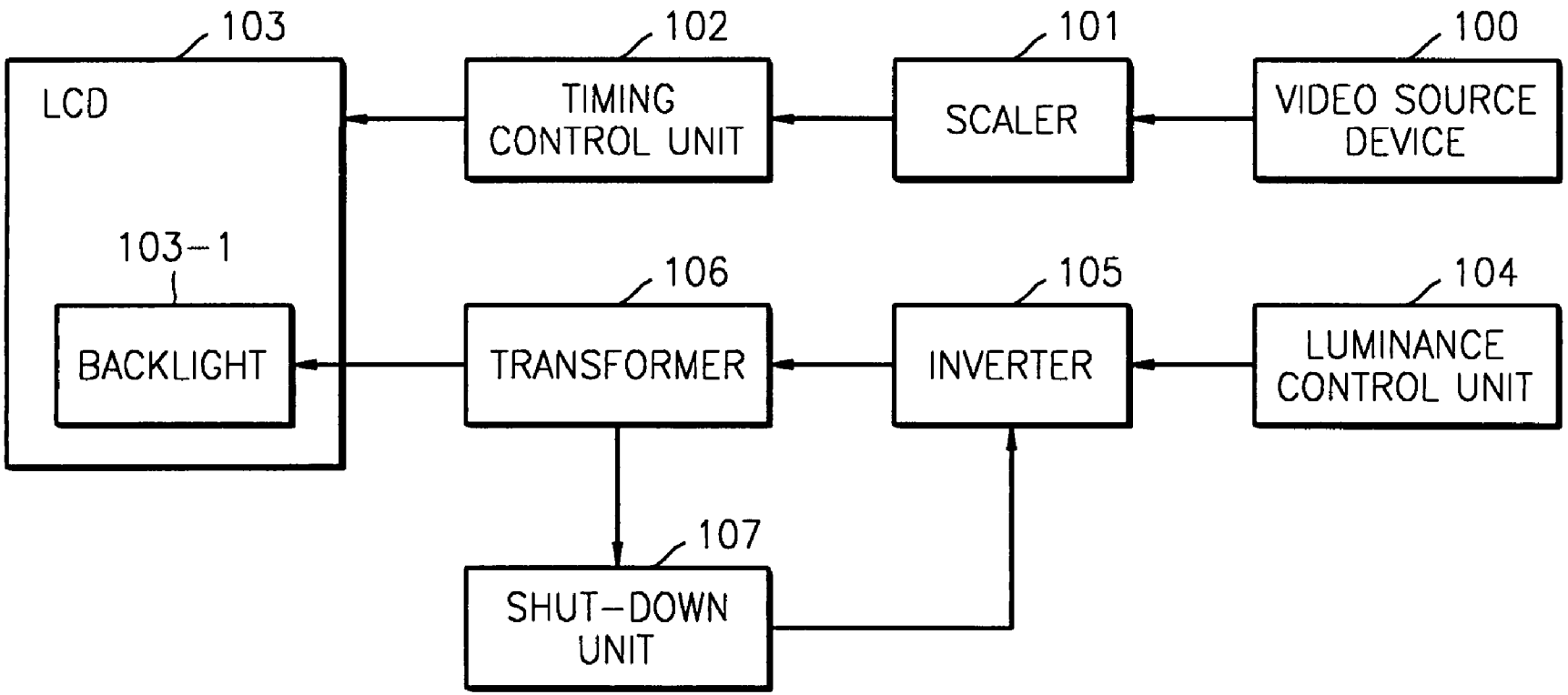
FIG. 1 (PRIOR ART)
FIG. 1 is a block diagram of a conventional LCD backlight inverter system.

Reference will now be made in detail to the embodiments of the present invention, examples of which are illustrated in the accompanying drawings, wherein like reference numerals refer to the like elements throughout.

Figure 2:
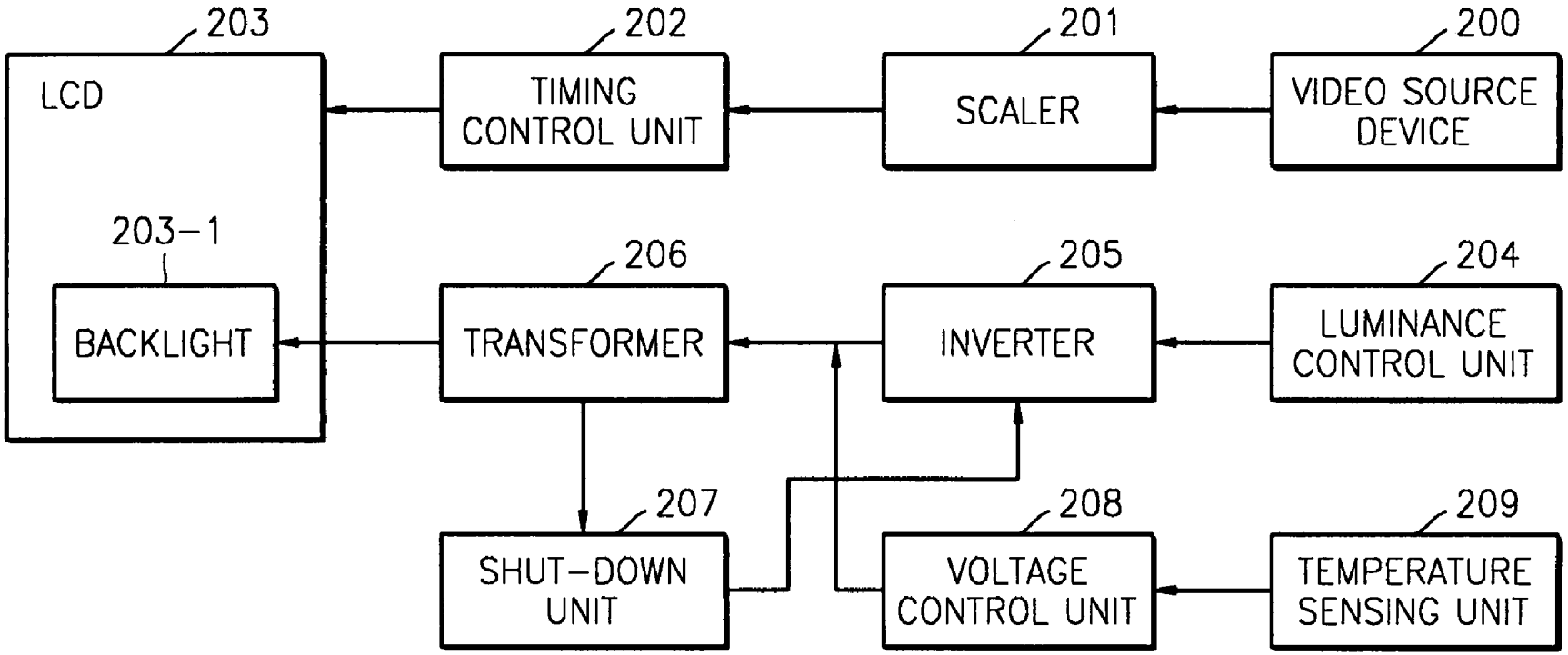
FIG. 2 is a block diagram of a display apparatus according to an aspect of the present invention.

As shown in FIG. 2, the display apparatus includes: a video source device 200, a scaler 201, a timing control unit 202, an LCD 203 having a backlight 203-1, a luminance control unit 204, an inverter 205, a transformer 206, a shut-down unit 207, a voltage control unit 208, and a temperature sensing unit 209.

Figure 3:
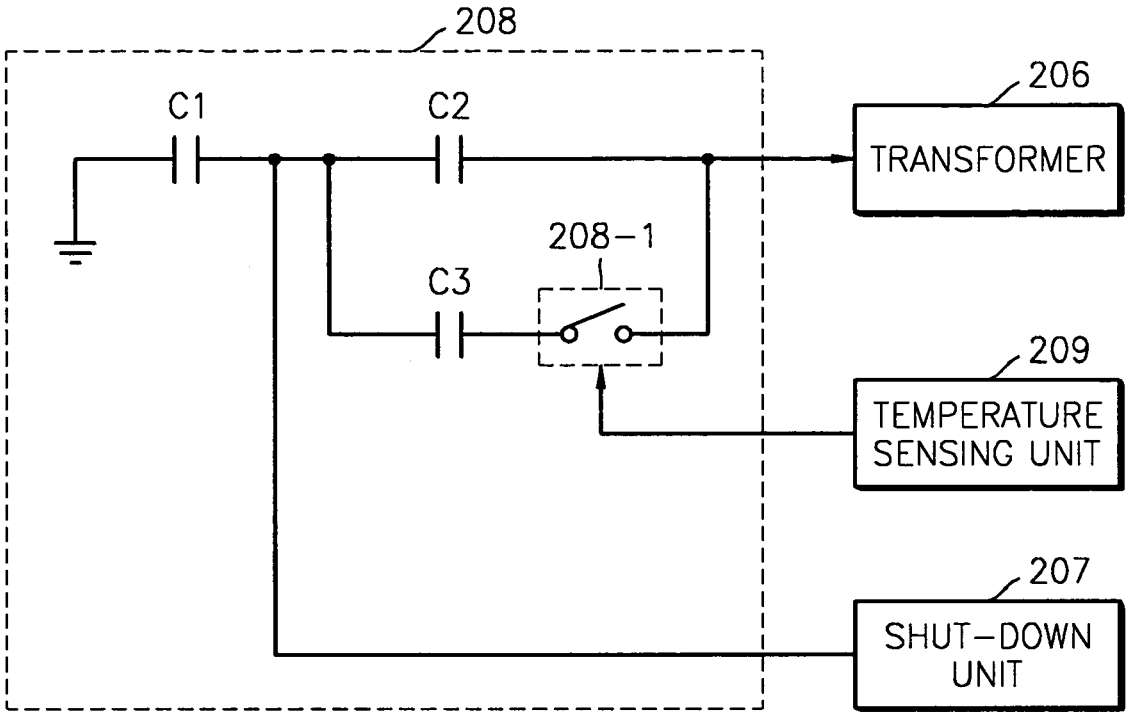
FIG. 3 is a detailed view of a voltage control unit of FIG. 2.

FIG. 3 is a detailed view of the voltage control unit 208 according to an aspect of the present invention.

Figure 4:
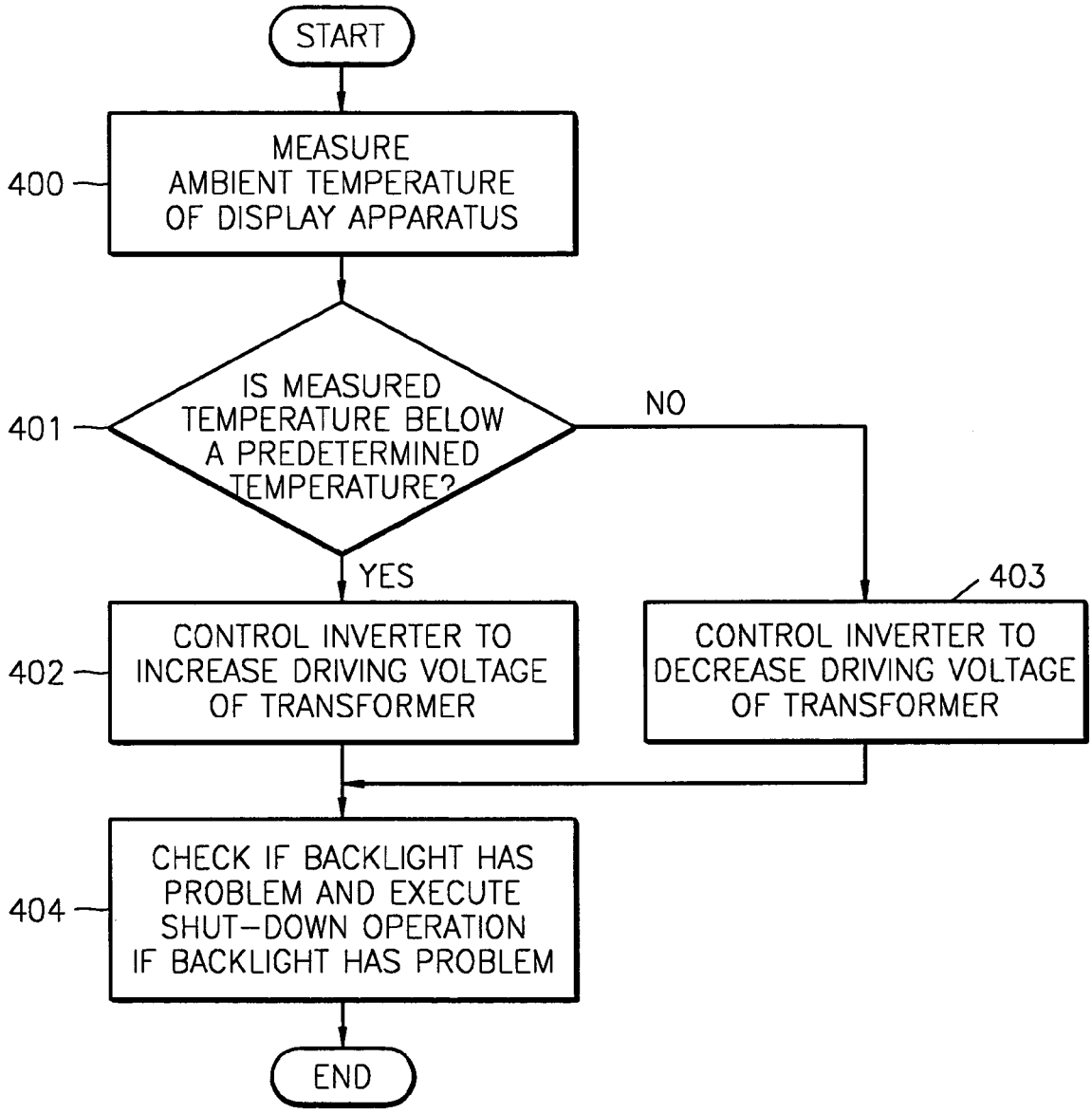
FIG. 4 is a flowchart to describe a display method according to an aspect of the present invention.

As shown in FIG. 4, a display method according to an aspect of the present invention includes: operation 400 to measure ambient temperature of a display apparatus, operation 401 to determine whether the measured temperature is below a predetermined temperature, operation 402 to control an inverter to increase a driving voltage of a transformer, operation 403 to control the inverter to decrease the driving voltage of the transformer, and operation 404 to check if a backlight has any problem and executing a shut-down operation if the backlight has a problem.

Hereinafter, an aspect of the present invention will be described with reference to FIGS. 2 through 4.

Referring to FIGS. 2 and 3, the video source device 200 generates a video source and processes the video source as displayable signals. The video source device 200 is a video processor such as a DVD player, a camcorder, a notebook PC or other similar video processors.

The scaler 201 scales video signals from the video source device 200, and outputs the scaled video signals.

The timing control unit 202 holds the video signals output from the scaler 201, and outputs the video signals to the LCD 203, while the luminance control unit 204 outputs a luminance control signal of the backlight 203-1 that lights the back of an LCD panel to make a screen of the LCD 203 highly visible.

The inverter 205 generates a PWM frequency to control the luminance of the backlight 203-1 in response to the luminance control signal output from the luminance control unit 204, and outputs the PWM frequency to the transformer 206. According to the inverter 205, when an applied voltage Vcc decreases, the output PWM frequency decreases, a duty ratio increases, and the amount of current increases. In addition, the inverter 205 checks a state of the backlight 203-1, and executes a shut-down operation to prevent damage to the display apparatus that may result due to over current.

The transformer 206 transforms the PWM frequency output from the inverter 205 to operate the backlight 203-1.

When a problem occurs due to a change in a backlight driving voltage, the shut-down unit 207 maintains a current applied to the backlight 103-1, and automatically stops the operation of the inverter 105 to prevent any damage to the display apparatus.

The temperature sensing unit 209 measures the ambient temperature of the LCD 203, and determines whether to adjust the backlight driving voltage. The temperature sensor 209 may be added to the conventional LCD backlight inverter system of FIG. 1 or included inside the inverter 205. The cost of the temperature sensing unit 209 is very low, and thus, the additional cost of employing it is small. When the temperature sensing unit 209 is included inside the inverter 205, the cost does not increase.

The voltage control unit 208 controls the driving voltage and a start-up voltage of the transformer 206 based on the measured temperature.

FIG. 3 is a detailed view of the voltage control unit 208 of FIG. 2 according to an aspect of the present invention. Accordingly, when the temperature sensing unit 209 determines that the measured temperature is below a predetermined temperature, the temperature sensing unit 209 outputs an on switching signal to increase the driving voltage of the transformer 206. The inverter 205 controls the driving voltage of the transformer 206 using high-voltage capacitors C1–C3 around the output voltage of the backlight 203-1. Once the temperature sensing unit 209 measures the ambient temperature of the display apparatus and outputs the on switching control signal, the capacitances of the capacitors C1–C3 change, and thus, the driving voltage of the transformer 206 is controlled. Further, according to an aspect of the present invention, a voltage controlling device 208-1 is provided to the voltage control unit 208, to control the voltage applied to the backlight. This operation makes the display apparatus operate in a stable manner because use of high driving voltage at a low temperature, and low driving voltage at a high temperature is permitted.

Hereinafter, a display method according to an aspect of the present invention will be described with reference to FIG. 4. In operation 400, the temperature sensing unit 209 measures the ambient temperature of the display apparatus. The temperature sensing unit 209 senses the ambient temperature of the LCD 203 and determines whether the driving voltage of the transformer 206 should be adjusted. Again, the temperature sensing unit 209 may be added to the conventional LCD backlight inverter system of FIG. 1 or included inside the inverter 205. The cost of the temperature sensing unit 209 is very low, and thus, the additional cost of employing it is small.

In operation 401, the temperature sensor 209 compares the measured temperature with a predetermined temperature. Upon determining that the measured temperature is below the predetermined temperature, the voltage control unit 208 controls the inverter 205 to increase the driving voltage of the transformer 206 in operation 402. In order to increase the driving voltage of the transformer 206, the temperature sensing unit 209 outputs the on switching signal to increase the driving voltage of the transformer 206. The driving voltage of the transformer 206 is controlled by the inverter 205 using the high-voltage capacitors C1–C3 around the output voltage of the backlight 203-1. Once the temperature sensing unit 209 measures the ambient temperature of the display apparatus and outputs the on switching control signal to the switching unit 209-1, the capacitances of the capacitors C1–C3 change, and thus, the driving voltage of the transformer 206 is controlled. Accordingly, the display apparatus operates in a stable manner by applying a high driving voltage at a low temperature, and a low driving voltage at a high temperature.

In contrast, upon determining that the measured temperature is above the predetermined temperature, the voltage control unit 208 controls the inverter 205 to decrease the driving voltage of the transformer 206 in operation 403.

After the driving voltage of the transformer 206 is controlled, the shut-down unit 207 checks whether the backlight 203-1 has a problem. Upon determining the backlight 203-1 has a problem, the shut-down unit 207 executes the shut-down operation in operation 404. If something inside the backlight 203-1 breaks or some problem occurs due to change in the driving voltage, the shut-down unit 207 stops the current from flowing through the backlight 203-1 and maintains the current applied to the backlight 103-1, thus stopping the operation of the inverter 205 to prevent any damage to the display apparatus.

As described above, an ambient temperature of the display apparatus is measured, and the backlight driving voltage is controlled according to the measured ambient temperature, thereby providing for a stable operation of the display apparatus.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A display apparatus, comprising: a backlight to provide light to the display apparatus; a temperature sensing unit to measure ambient temperature of the display apparatus; and a voltage control unit to compare the measured temperature to a predetermined temperature, and to control a voltage applied to the backlight based upon the comparison result; wherein the voltage control unit increases the voltage applied to the backlight by a predetermined value when the measured temperature is below the predetermined temperature; and the voltage control unit decreases the voltage applied to the backlight by the predetermined value when the measured temperature is above the predetermined temperature.

2. A display apparatus, comprising:

a backlight to provide light to the display apparatus;

a temperature sensing unit to measure ambient temperature of the display apparatus; and a voltage control unit to compare the measured temperature to a predetermined temperature, and to control a voltage applied to the backlight based upon the comparison result;

wherein the voltage control unit further comprises:

a switching unit to output an on switching signal or an off switching signal in accordance with the comparison result; and a voltage controlling device to control the voltage applied to the backlight in response to the on switching signal or the off switching signal.

3. A method to operate a display apparatus, comprising: measuring ambient temperature of the display apparatus; and comparing the measured temperature to a predetermined temperature; and controlling a voltage applied to a backlight that provides light to the back of the display apparatus based upon the comparison result; wherein the comparing of the measured temperature with the predetermined temperature comprises: increasing the voltage applied to the backlight by a predetermined value when the measured temperature is below the predetermined temperature; and decreasing the voltage applied to the backlight by the predetermined value when the measured temperature is above the predetermined temperature.

4. A method to operate a display apparatus, comprising:

measuring ambient temperature of the display apparatus; and comparing the measured temperature to a predetermined temperature; and controlling a voltage applied to a backlight that provides light to the back of the display apparatus based upon the comparison result;

wherein the comparing of the measured temperature with the predetermined temperature comprises:

outputting an on switching signal or an off switching signal based on the comparison result; and controlling the voltage applied to the backlight in response to the on switching signal or the off switching signal.

5. A method to operate a display apparatus, comprising:

measuring ambient temperature of the display apparatus;

determining whether the measured temperature is below a predetermined temperature;

controlling an inverter to increase and decrease a driving voltage of a transformer based upon the comparison result;

determining whether a backlight has a problem; and executing a shut-down operation upon determining that the backlight has a problem.

6. A display apparatus having a backlight to light the display apparatus, comprising:

a temperature sensing unit to measure ambient temperature of the display apparatus;

a voltage control unit to compare the measured temperature to a predetermined temperature, and to control a voltage applied to the backlight based upon the comparison result;

an inverter to control luminance of the backlight; and a shut-down unit to maintain the voltage applied to the backlight, and to automatically stop an operation of the inverter to prevent any damage to the display apparatus.

7. The display apparatus of claim 6, wherein the temperature sensing unit is included in the inverter.

8. The display apparatus of claim 6, further comprising:

a transformer to drive the voltage; and a plurality of high voltage capacitors provided to allow control of the driving voltage of the transformer.

9. The display apparatus of claim 8, wherein the inverter controls the driving voltage of the transformer via the plurality of high voltage capacitors around an output voltage of the backlight.

10. The display apparatus of claim 9, wherein the capacitance of the plurality of capacitors is changed to control the driving voltage of the transformer based upon the measured ambient temperature of the display apparatus.

* * * * *